United States Patent [19]

Morgan et al.

[11] Patent Number: 5,020,611

[45] Date of Patent: Jun. 4, 1991

[54] CHECK VALVE SUB

[76] Inventors: Alan K. Morgan; Timothy R. Schamburger, both of 40 Industrial Loop, Midland, Tex. 79701

[21] Appl. No.: 364,747

[22] Filed: Jun. 9, 1989

[51] Int. Cl.[5] ..... E21B 17/18; E21B 21/10; E21B 21/12

[52] U.S. Cl. ..... 175/215; 137/515; 175/318; 175/320; 175/324; 285/133.1

[58] Field of Search ..... 175/213, 215, 218, 214, 175/318, 317, 324, 320; 285/133.1, 133.2; 166/326, 327, 325, 202; 137/515, 860

[56] References Cited

U.S. PATENT DOCUMENTS

| | | | |
|---|---|---|---|
| 2,946,565 | 7/1970 | Williams . | |
| 2,992,841 | 7/1961 | Steinberger | 166/202 |
| 3,075,589 | 1/1963 | Grable et al. | 175/215 |
| 3,077,358 | 2/1963 | Costa | 175/215 |
| 3,082,825 | 3/1963 | Hanner, Sr. | 166/185 |
| 3,173,502 | 3/1965 | Overby | 175/214 X |
| 3,360,061 | 12/1967 | Canalizo | 175/215 X |
| 3,471,177 | 10/1969 | Garrett et al. | 285/133.1 |
| 3,664,443 | 5/1972 | Campbell | 175/215 X |
| 3,724,541 | 4/1973 | Curry | 166/224 |
| 3,978,923 | 9/1976 | Ford | 175/215 X |
| 4,149,566 | 4/1979 | Stowe | 166/202 X |
| 4,171,187 | 10/1979 | Reed | 175/215 X |
| 4,337,563 | 7/1982 | Becker et al. | 175/215 X |
| 4,384,615 | 5/1983 | Luers | 166/326 |
| 4,385,668 | 5/1983 | Becker et al. | 175/215 X |
| 4,618,172 | 10/1986 | Becker | 285/133.2 X |
| 4,682,661 | 7/1987 | Hughes et al. | 175/215 |

FOREIGN PATENT DOCUMENTS

| | | | |
|---|---|---|---|
| 1213168 | 2/1986 | U.S.S.R. | 175/215 |

*Primary Examiner*—Hoang C. Dang

*Attorney, Agent, or Firm*—Marcus L. Bates

[57] ABSTRACT

A check valve sub assembly for series connection in a dual pipe string that extends downhole in a borehole for permitting flow of fluid in one direction through the annular passageway of the dual pipe string and preventing flow of fluid in the other direction. The check valve sub assembly includes an inner tube and an outer annular member for connection into series relationship respective to the inner and outer dual pipe so that fluid flow through the inner pipe is conducted through said inner tube and is maintained separate from the annulus. A check valve having an elastomeric sealing member in the form of a frustum of a cone and an axial passageway formed therethrough sealingly engages the outer circumferential wall surface of said inner tube; whereby fluid flow through the annulus in one direction forces the small diameter end of the elastomer into sealed engagement respective to the inner tubing while fluid flow in the opposite direction forces said elastomer away from said inner tube to permit the flow of fluid therebetween.

8 Claims, 2 Drawing Sheets

CHECK VALVE SUB

BACKGROUND OF THE DISCLOSURE

For many years drilling rigs have utilized the concentric pipe method of drilling wherein a fluid, such as air or a mixture of compressible and incompressible fluids, is forced down the annulus between an inner and outer drill pipe to a drill bit located at the lower end of the concentric string, whereupon cuttings formed by the bit are forced to travel back uphole through the inner pipe, and to the surface of the ground.

From time to time, while making hole, it is necessary to add or subtract another joint of inner and outer pipe respective to the concentric drill string and when this happens, all of the liquids and solids contained within the inner pipe and the annulus between the pipes gravitate back down toward the bit, seeking equilibrium of the hydrostatic head in the two columns of fluid. The cuttings congregate and coagulate at the bottom of the borehole and usually the weight of the fluid and cuttings in the inner pipe exceeds the pressure available in the annulus between the inner and outer tube, whereupon, the fluid and cuttings will migrate into the annulus. Often, this mixture will have a consistency between mud and wet concrete and when an extended time delay in restoring the drilling air supply occurs, it is possible for the system to become clogged. It would therefore be desirable to provide an automatic check valve device in the annulus between the inner and the outer tubing whereby flow downhole through the annulus toward the bit occurs with little pressure drop across the valve device while reverse flow is precluded. This desirable feature enables the inner tubing to remain loaded with fluid rather than seeking equilibrium with the fluid in the annulus.

This check valve device therefore blocks the migration of fluid from the axial passageway into the annulus of the concentric pipe and simultaneously reduces the time required to repressure the drilling pipe and restore the drilling operation. Accordingly, the check valve sub can be installed in the concentric string of drill pipe where it serves as a one way fluid or air trap.

Therefore, the check valve sub of this invention can be located in series relationship with respect to the concentric drilling pipe. Preferably the check valve sub is located near the bit to reduce the volume of compressible gases that may be trapped downhole of the check valve within the annulus.

The provision of an improved check valve sub that achieves the above goals is the subject of this invention.

SUMMARY OF THE INVENTION

This invention comprehends a check valve sub assembly for series connection into a dual pipe string that retains the hydrostatic head in the inner pipe by preventing uphole flow of fluid within the annulus between the inner and outer pipes, while at the same time permitting the downhole flow of drilling fluid through the annulus.

More specifically, the check valve sub assembly of the present invention comprises a main outer annular body for series connection respective to the outer pipe of the dual pipe string, and an inner annular body member for series connection to the inner pipe or inner tubing of the dual pipe string, thereby providing an annular area between the two annular body members. A medial length of the outer annular body has attached thereto an annular elastomeric member having a memory causing it to sealingly engage the exterior surface of the inner pipe and thereby act as a check valve for preventing flow uphole while permitting flow downhole. The outer annular body includes spaced tube supports by which the inner and outer annular members are concentrically arranged respective to one another. One of the tube supports includes a releasable fastener means by which the inner and outer annular members are locked in relative position to prevent axial movement of one respective to the other.

A primary object of the present invention is to provide apparatus for use in conjunction with concentric drill pipe which precludes uphole flow through the annulus between the inner and outer pipe and which permits downhole flow therethrough.

Another object of the present invention is the provision of a resilient, annular elastomeric member. When positioned within the annulus between concentric dual drill pipe the elastomeric member has a memory which biases the elastomeric member into sealing engagement with respect to the outer surface of the inner pipe and thereby forms a check valve.

A still further object of this invention is the provision of a check valve sub assembly for series connection into a dual string drill pipe which permits downward flow of fluid through the annulus between the drill pipe and precludes uphole flow therethrough.

A still further object of the present invention is the provision of a check valve sub assembly for series connection in a dual pipe string that permits flow to occur downhole through the annulus and back uphole through the inner pipe, and which precludes loss of hydrostatic head within the inner pipe due to obstruction of the annular area by the resilient device whenever uphole flow occurs through the annulus.

Another and still further object of this invention is the provision of a check valve sub for a dual drill pipe string having a resilient elastomer of annular configuration that forms a frustum of a cone and sealingly engages the outer wall surface of the inner pipe and the inner wall surface of the outer pipe to form a check valve which precludes uphole flow through the annulus and permits downhole flow through the annulus whereby the hydrostatic head within the inner pipe is maintained whenever the circulation through the annulus is terminated and thereby reduces the time to repressure the dual pipe string as well as reducing clogging effects that may otherwise occur where the hydrostatic head of the system is allowed to reach equilibrium.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
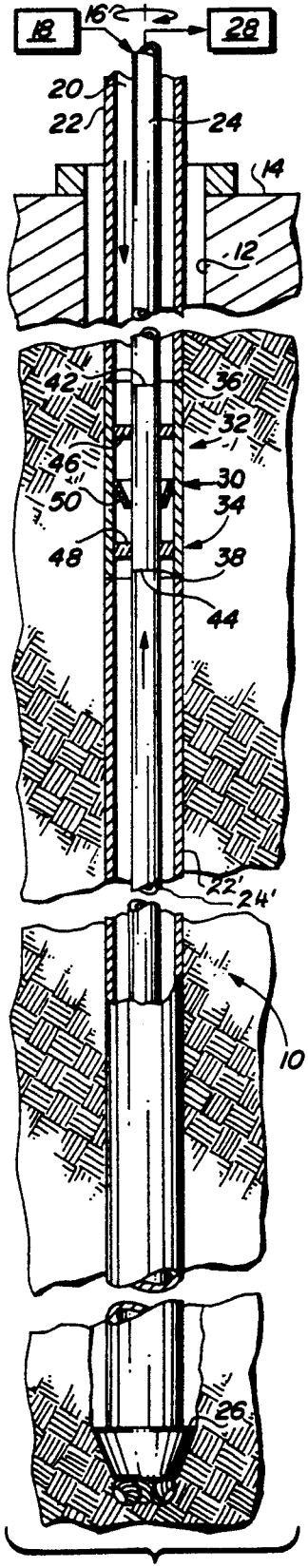
FIG. 1 is a part schematical, part diagrammatical, part cross-sectional view of the earth and showing a drilling operation that includes the present invention in conjunction therewith.

FIG. 1 of the drawings schematically discloses a drilling operation 10 carried out by the concentric or dual pipe string method. A borehole 12 is being formed and it extends below the surface 14 of the ground as the dual string is rotated by a rotary drilling rig symbolically shown by the curved arrow 16. Fluid, such as a mixture of air and water, or gas, flows from a suitable supply 18 into the pipe annulus 20 formed between the outer drill pipe 22 and the inner pipe 24, and downhole to the illustrated drill bit 26. The fluid admixes with cuttings formed by the bit and flows back up through the inner concentric pipe 24 and to a separator and then to a mud pit 28 or the like.

Numeral 30 indicates a medial length of the concentric drill string within which there is series connected a check valve sub assembly 32 made in accordance with the present invention. The sub 32 includes upper and lower outer annular members 33 and 34 having an upper end 36 and a lower end 38. The sub is connected to be a continuation of outer upper and lower concentric pipe 22, 22'.

Figure 2:
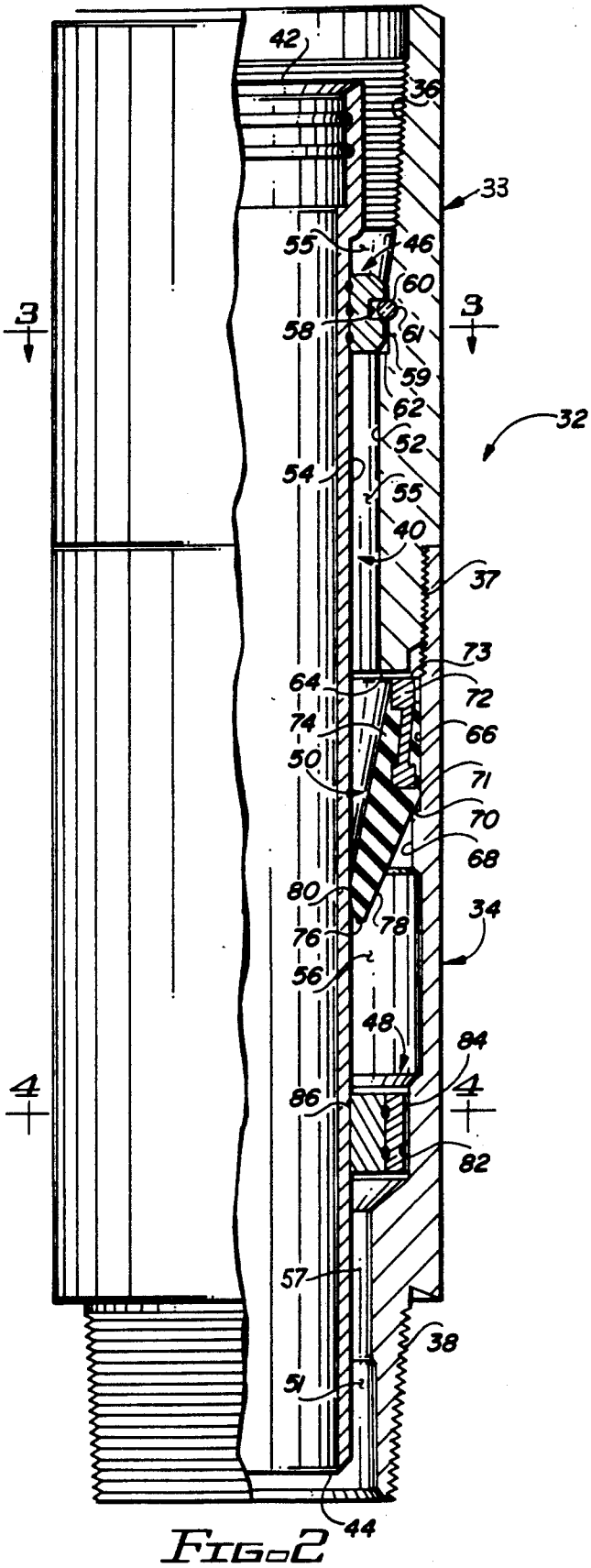
FIG. 2 is an enlarged, longitudinal, part cross-sectional, elevational view of part of the apparatus disclosed in FIG. 1.

In FIG. 2, the sub assembly 32 includes an inner annular member or tube 40 having an upper end 42 and lower end 44 connected into series relationship respective to the inner drill pipe 24 (FIG. 1) and is a continuation of the upper and lower pipe sections 24, 24' (FIG. 1). In FIGS. 2, 3, 4, and 5, an inner tube support and locking ring assembly 46 is supported by the outer annular member 33 and locks the inner tube 40 against axial movement respective to the outer annular member 33.

A stabilizer ring and lower support 48 slidably receives the inner tube 40 therethrough and maintains the inner tube concentrically arranged respective to the outer annular member 34. The outer annular member 34 further includes an annular elastomeric check valve device 50 which is removably mounted in fixed or captured relation respective to the interior wall surface of outer annular member 34 and sealingly engages the outer peripheral wall surface of the inner tube 40, as will be disclosed in greater detail later on.

Figure 3:
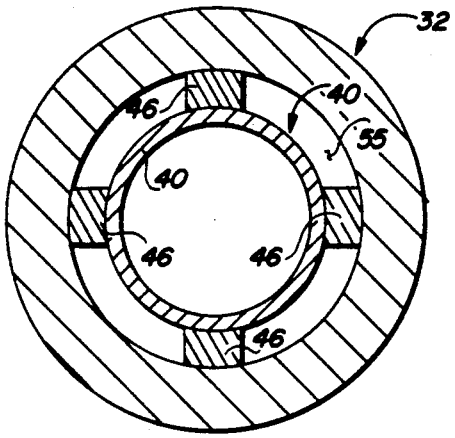
FIGS. 3 and 4, respectively, are cross-sectional views taken along lines 3—3 and 4—4, respectively, of FIG. 2; and, FIG. 5 is a perspective, exploded view of the apparatus disclosed in FIG. 2, with some parts being removed and the remaining parts being shown in cross-section.
Figure 4:
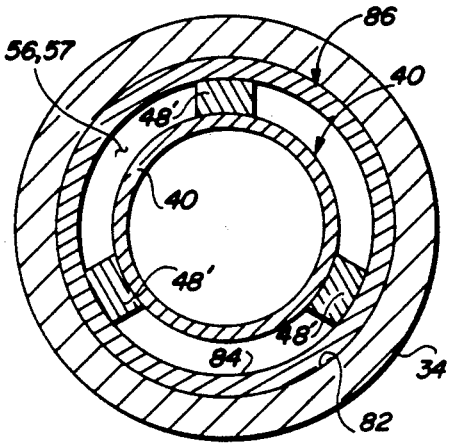

FIGS. 2, 3, 4 and 5 disclose additional details of the check valve sub assembly 32. The outer annular member 33 has an inner wall surface 52. Tubing 40 has an outer surface 54 spaced from surface 52 and forms pipe annulus 55 therebetween. The pipe annulus 55, as seen in FIGS. 2 and 3, extends uphole and is interrupted only by the before mentioned inner tube support and locking ring. As also seen in FIG. 3, ample space is provided by the four circumferentially spaced passageways to permit flow thereacross.

In FIG. 2, annulus 56 lies below the check valve device 50 and is a continuation of annulus 55. Annulus 57 lies below annulus 56 and is a continuation of annulus 55 and 56 except for the interruption of the radially spaced centralizers 48 which leave ample flow passageways therebetween as particularly seen in FIG. 4.

The inner tube support and locking ring assembly 46 include a circumferentially extending continuous groove 61 formed in the inner sidewall 52 of the outer annular member 33. A locking ring 60 is removably received within groove 61. The locking ring is discontinuous and has means formed at opposed terminal ends thereof by which it can easily be engaged with suitably designed pliers and compressed further into slot 58 of the four tube supports 46, thereby releasing the inner tube support 46 from the outer annular member 33.

Numeral 62 illustrates a shoulder that is formed between a cylindrical surface at 59 and cylindrical surface 52. Shoulder 62 abuttingly engages the near face of each of the illustrated four radially spaced inner tube supports. The four circumferentially spaced inner tube supports 46 are welded to the outer surface of the inner tube 40 and extend radially from the axis thereof.

Numeral 64 indicates the lower terminal end of the upper section of the annular member 33. Cylindrical surface 66 is separated from cylindrical surface 68 by the illustrated circumferentially extending shoulder 70 which is formed therebetween. The check valve device 50 has opposed, circumferentially extending, spaced surfaces 71, 73 which are abuttingly engaged by the confronting end portion 64 and shoulder 70, thereby capturing the check valve assembly 50 in compression therebetween in the illustrated position best seen in FIG. 2.

Metal annular reinforcement 72 preferably is embedded within the elastomer 74 and adds rigidity to the upper marginal end of the check valve assembly 50. The check valve assembly 50 is a frustum of a cone having an axial passageway formed therethrough and thereby results in a downwardly and inwardly directed annular skirt having a fixed end at member 72 and a free end at 76. The outer surface 78 of the annular skirt is spaced form the inner surface 68 of the lower section of the annular outer member 34, while the circumferentially extending inner reduced diameter surface 80 of the elastomer sealingly engages the outer surface 54 of the inner tubing 40.

The memory of the elastomer of check valve assembly 50 biasees surfaces 54, 80 against one another and when the pressure differential thereacross is increased in an uphole direction, the force acting against surface 78 bears against the elastomer with a force which is proportional to the pressure drop thereacross and thereby precludes uphole flow through pipe annulus 55. On the other hand, downward flow through pipe annulus 55 biases the free end 76 of the skirt towards the outer annular member 34 and opens check valve 50 to provide an annular port for flow during normal drilling conditions. At high flow rates the surface 78 can be moved against surface 68.

The individual lugs of the stabilizer ring and lower support 48 includes a continuous outer ring 86 received against cylindrical surface 82 of the lower section of annular member 34. Lugs 48, spaced 120 degrees apart, are welded to ring 86 and have an inner surface 84 spaced respective to one another to slidably receive the inner tube 40 therethrough to thereby maintain the inner tube concentrically arranged respective to the outer annular member 34.

In FIG. 2, the inner tubing 40 has locking ring 60 placed within slots 58 of the radially arranged and circumferentially spaced lugs 46, with the inner tubing 40 being telescopingly received axially within the passageway of check valve assembly 50, and through the stabilizer ring and lower support 48.

Figure 5:
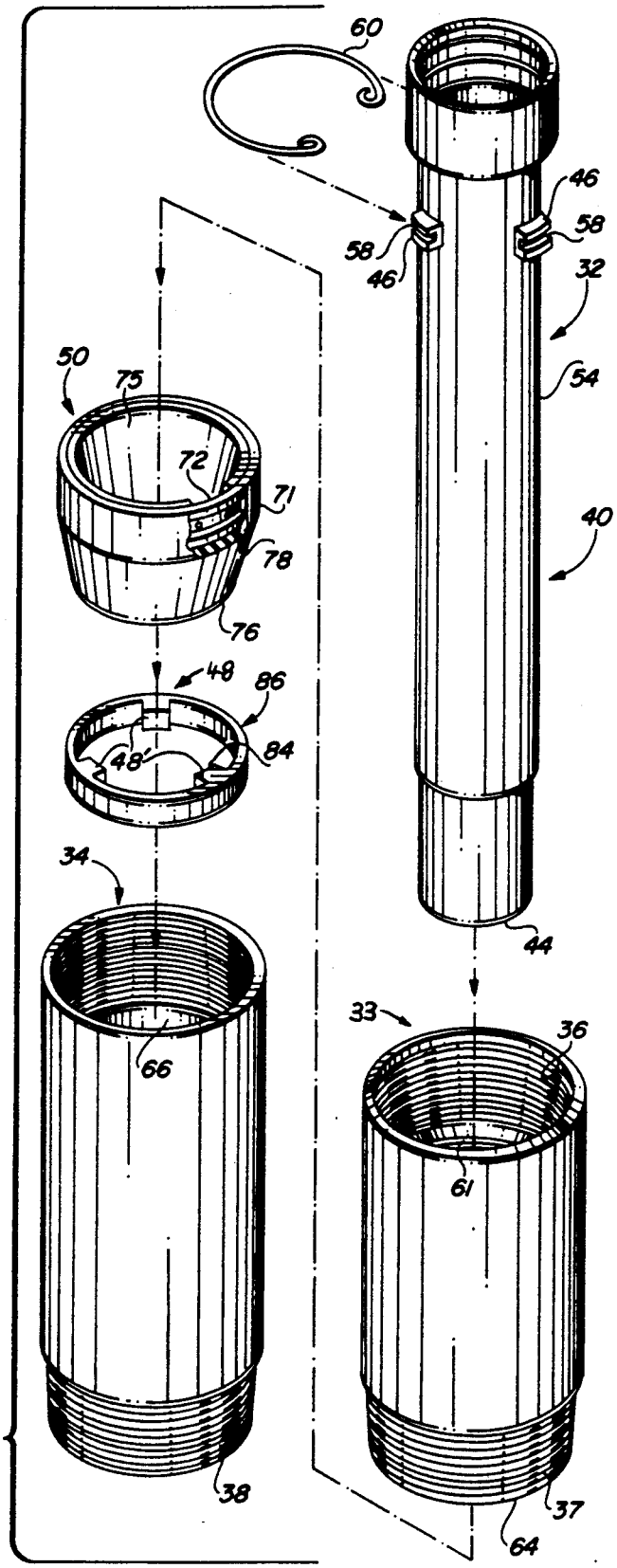

In FIG. 5, the locking ring 60 has been removed from slots 58 and annular groove 61. The locking ring 60 is placed within slots 58 and the end 44 of tube 40 telescoped into the assembled annular member 34.

Continued downward movement of the inner tubing will bring the locking ring 60 into seated engagement respective to circumferentially extending groove 61, thereby locking inner tubing 40 within sub 33 in the illustrated manner of FIG. 2. At this time, the tool is ready to be connected in series relationship respective to the sections of concentric dill pipe 22, 24, 22', 24'.

In the disassembled view set forth in FIG. 5, it will be appreciated that check valve assembly 50 must be placed within the cylindrical cavity 66 (FIG. 2.) and thereafter the upper and lower sections of the outer annular members 33 made up; thereby capturing the check valve 50 in the illustrated manner of FIG. 2. Next, the inner tubing is telescopingly received within annular members 33 and 34 in the before described manner.

After the tool has been run downhole in series relationship with respect to the concentric drill string, and used in a drilling operation, it subsequently can be rebuilt by reaching through the annulus 55 and engaging the terminal ends of the lock ring 60 with a suitable pair of elongated snap ring pliers. Compression of the ring releases the inner tube barrel from the circumferentially extending groove 61 of the annular member, and thereafter the upper and lower members of the sub are broken out, thereby releasing the check valve assembly 50 from its cylindrical cavity 66. The tool is cleaned up and reassembled with a new check valve assemby 50 and is then made ready to be run back downhole again.

The apparatus of the present invention enables the hydrostatic head contained within tubing 40 to be maintained at a high level in the borehole rather than reach equilibrium with any fluid contained in annulus 55. The elastomeric check valve element 50 is especially adapted for handling abrasive drilling fluids and will always seal and prevent uphole flow of fluid thereacross due to its ability to envelop foreign matter and seal to the outer surface of the inner tubing rather that be propped open as would be expected with most mechanical type valve devices.

We claim:

1. A check valve sub assembly for series connection in a dual pipe string, said check valve sub assembly comprising an outer annular body member for series connection to the outer pipe of a dual pipe string and an inner annular body member for series connection to the inner pipe of a dual pipe string;

said inner annular body member and said outer annular body member jointly form an annular space therebetween that can communicate with an annulus between the pipes of the dual pipe string;

said outer annular body member comprises an upper sub removably connected to a lower sub to form an annular chamber therebetween; an annular check valve received within said annular chamber; said check valve includes an annular elastomeric member removably received within said annular chamber, said elastomeric member extends from said outer annular body member into resilient engagement with the outer surface of said inner annular body member; said annular elastomeric member divides said annular space into an upper annular area and a lower annular area;

said annular elastomeric member is in the form of a frustum of a cone having a passageway formed axially therethrough through which said inner annular body member is telescopingly received in sealed relationship therewith whereby uphole flow of fluid through the annular space results in the elastomeric member sealingly engaging the inner surface of the outer annular member and the outer surface of the inner annular member, while downhole flow of fluid through said annular space forces the elastomeric member away from the inner annular body and provides an annular flow path therebetween;

an inner tube support and locking ring assembly comprising a circumferentially extending groove formed about the inner wall surface of the outer annular member, a plurality of inner tube supports, each affixed to said inner annular member and radiating therefrom, each of said tube supports have a groove formed therein that registers with said circumferentially extending groove; a locking ring positioned within the circumferentially extending groove of the outer annular member and grooves of the inner tube supports;

and a shoulder spaced below said circumferentially extending groove against which said spaced tube supports are abuttingly received.

2. The check valve sub assembly of claim 1 and further including a lower alignment means positioned at the lower annular space that includes a stabilizer ring and lower support, said stabilizer ring is affixed to the inner wall of said outer annular member, a plurality of spaced lugs is affixed to said ring and extends towards the axial centerline of the annular members and having an inner surface that receives said inner annular member in close tolerance relationship therewith.

3. The check valve sub assembly of claim 1, wherein a cylindrical surface is formed between spaced shoulders at the lower end of said upper sub and the upper marginal end of said lower sub; said spaced shoulders confront one another and form said annular chamber therebetween; said annular elastomeric member has an annular reinforcing member embedded therein and opposed shoulders thereon that are received between the confronting spaced shoulders that define said cylindrical surface;

said elastomeric member downwardly and inwardly extends from said annular reinforcing member and into contact with the outer surface of said inner annular body member.

4. In a borehole forming operation having inner and outer concentric pipes extending downhole and forming an inner passageway and an annular passageway; the combination with said concentric pipes of a check valve sub for series connection respective to said inner and outer pipes;

said check valve sub assembly includes an inner annular body member for series connection to the inner concentric pipe of the dual pipe string and an outer annular body member for connection to the outer concentric pipe of the dual pipe string; an annular passageway formed between said inner annular body member and said outer annular body member;

said outer annular body member comprises an upper annular member removably connected to a lower annular member; and means forming a cylindrical annular chamber therebetween; an annular check valve means received within said cylindrical annular chamber, said check valve means includes an annular elastomeric member removably received within said cylindrical annular chamber, said elastomeric member extends from said outer annular body member into resilient engagement with the outer surface of said inner annular body member;

alignment means located within the annular passageway for maintaining the inner and outer annular members in concentric relationship respective to one another; said alignment means releasably holding said inner and outer members together and prevents axial movement therebetween; said alignment means includes an inner tube support and locking ring assembly supported by said outer annular member for releasably attaching said inner annular member and said outer annular member together; a groove formed in the inner sidewall of said outer annular body member, a groove formed in the outer surface of said inner tube support, the locking ring being removably received in the groove of the outer annular body member and the groove of the inner tube support;

said annular elastomeric member is in the form of a frustum of a cone having a passageway formed axially therethrough through which said inner annular member is telescopingly received in sealed relationship therewith whereby uphole flow of fluid forces the elastomeric member to sealingly engage the inner surface of the outer member and the outer surface of the inner member, while downhole flow of fluid through said annulus forces the elastomeric member away from the inner annular member and provides an annular flow path between the inner and outer annular body members.

5. The check valve sub assembly of claim 4, wherein said alignment means further includes a stabilizer ring and lower support located below said elastomeric member; said lower support having a ring affixed to the inner wall of said outer annular member, a plurality of spaced lugs affixed to said ring and extending towards the axial centerline of said annular member and having an inner surface that telescopingly receives said inner annular member in close tolerance slidable relationship therewith.

6. The check valve sub assembly of claim 5, wherein confronting spaced surfaces on said outer annular member define said cylindrical chamber, said annular elastomeric member has an annular reinforcing member embedded therein and opposed shoulders thereon that are received between the confronting spaced surfaces that define said cylindrical chamber;

said elastomeric member downwardly and inwardly extends from said annular reinforcing member and into contact with the outer surface of said inner annular body member.

7. In a borehole having a dual, concentrically arranged pipe string extending therethrough and forming an axial flow path and an annular flow path for flow of fluid therethrough, an improved check valve sub assembly for series connection in said dual pipe string for permitting flow of fluid in one direction through the annular flow path and preventing flow of fluid in the opposite direction;

said check valve sub assembly includes an inner tube and an outer annular member; said inner tube having upper and lower ends for connection into series relationship respective to the inner pipe of the concentric pipe so that fluid flow through the inner pipe is conducted through said inner tube and is maintained separate from the annular flow path;

means for maintaining said inner tube concentrically arranged respective to said outer annular member;

an inner tube support, a locking ring, a circumferentially extending groove formed about the inner wall surface of the outer annular member, said inner tube support comprises a plurality of spaced tube supports, each having a groove formed therein that registers with said circumferentially extending groove; with said locking ring being received within the groove of the spaced tube supports and the groove of the outer annular member to releasably attach the outer annular member and the inner tube together;

and a shoulder spaced below said circumferentially extending groove against which said spaced tube supports are abuttingly received;

a check valve having an elastomeric sealing member in the form of a frustum of a cone and further includes an axial passageway formed therethrough and thereby provides a large diameter end opposed to a small diameter end;

said elastomeric sealing member is in the form of a downwardly and inwardly directed skirt and said inner tubing is telescopingly received in sealed relationship therewith;

means attaching said large diameter end of said sealing member to the inside circumferential wall surface of said outer annular member;

said small diameter end of said sealing member being of a size to sealingly engage the outside circumferential wall surface of said inner tube whereby fluid flow through the annular flow path in one direction forces the small diameter end of the sealing member into sealed engagement respective to said inner tube while fluid flow in the opposite direction forces said skirt of said sealing member away from said inner tube to permit the flow of fluid therebetween.

8. The check valve sub assembly of claim 7, wherein a stabilizer ring and lower support, including a ring is affixed to the inner wall of said outer annular member, a plurality of spaced lugs affixed to said ring and extending towards the axial centerline of said annular member and having an inner surface that receives said inner tube in close tolerance relationship therewith.

* * * * *